US005477585A

United States Patent [19]

Hentzschel et al.

[11] Patent Number: 5,477,585

[45] Date of Patent: Dec. 26, 1995

[54] SUCTION AND BLOWING DEVICE

[75] Inventors: Wolfgang Hentzschel, Filderstadt; Norbert Büchele, Waiblingen; Hans-Peter Dohse, Kernen, all of Germany

[73] Assignee: Electrostar Schottle GmbH & Co., Reichenbach, Germany

[21] Appl. No.: 291,626

[22] Filed: Aug. 17, 1994

[30] Foreign Application Priority Data

Aug. 23, 1993 [DE] Germany ..... 9312607 U

[51] Int. Cl.[6] ..... A47L 5/14; A47L 9/08

[52] U.S. Cl. ..... 15/330; 15/331; 15/345; 15/409

[58] Field of Search ..... 15/330, 331, 345, 15/409

[56] References Cited

U.S. PATENT DOCUMENTS

| | | | |
|---|---|---|---|
| 2,181,487 | 11/1939 | Khuen-Kryk | 15/345 |
| 3,221,358 | 12/1965 | Dickson | 15/345 |
| 3,942,216 | 3/1976 | Minton | 15/331 |
| 4,817,230 | 4/1989 | Kiyooka | 15/330 |
| 5,008,972 | 4/1991 | Steinike | 15/345 |

FOREIGN PATENT DOCUMENTS

| | | | |
|---|---|---|---|
| 451210 | 9/1948 | Canada | 15/330 |
| 294961 | 1/1929 | United Kingdom | 15/330 |

*Primary Examiner*—David Scherbel
*Assistant Examiner*—Randall E. Chin
*Attorney, Agent, or Firm*—Friedrich Kueffner

[57] ABSTRACT

A suction and blowing device exhibits three air conduits connected to a source of pressurized air and partially terminating in a common transport conduit and has a selectable control body located between the air conduit entrance openings and the pressurized air source for regulating the entrance of the pressurized air into the air conduits. The device allows for the selective direction of pressurized air to one or more of the three air conduits to perform completely different functions such as: suction with an injector nozzle, vacuum cleaning using an injector nozzle and an additional cleaning pressure jet, blowing using a nozzle with large dynamic pressure and air velocity, and blowing using an injector nozzle and high air through-put.

9 Claims, 7 Drawing Sheets

SUCTION AND BLOWING DEVICE

BACKGROUND OF THE INVENTION

The present invention concerns a suction device with a transport conduit having an air intake opening as well an air exit opening which exhibits, in the vicinity of its air intake opening, an injector nozzle directed in the direction of the suction and connected to a source of pressurized air.

In suction devices configured with injectors which are known in the art, primary air is injected into a transport conduit through the injector in the direction of suction so that secondary air located in the transport conduit is dragged along and, in the vicinity of the air intake opening of the transport conduit, a strong suction is created which transports a material to be suctioned to the air exit opening of the transport conduit.

It is the purpose of the present invention to fashion a device of this kind in such a manner that, by means of a simple switching mechanism, different suction as well as blowing procedures can be carried out in direct sequence during operation of the apparatus.

SUMMARY OF THE INVENTION

This purpose is achieved in accordance with the invention by means of three air conduits which are connected to a source of pressurized air and which partially terminate in a common transport conduit and with a selectable control body located between their entrance openings and the pressurized air source for regulating the entrance of the pressurized air into the air conduits. In this fashion it is possible to selectively direct the pressurized air source to one or more of the three air conduits provided and to thereby generate, in each case, completely different effects.

One thereby has a central control device fed by a common pressurized air source which, for example in an apparatus having an electrical motor or a combustion engine can, at different switch positions, carry out functions such as 1. suction using an injector nozzle,
2. vacuum cleaning using an injector nozzle and an additional cleaning pressure jet,
3. blowing using a nozzle with large dynamic pressure and air velocity,
4. blowing using an injector nozzle and high air throughput.

It is advantageous to utilize a rotary valve as a control body which alternately partially covers the adjacent air input openings of the conduits, whereby it is possible to freely and selectively control the introduction of the air stream in each case as needed in uninterrupted sequence.

It is useful when the first above mentioned air channel is connected to the jet nozzle adjacent to the air intake opening of the transport conduit which thereby functions as an injector from which a primary stream of air enters into the transport conduit in the direction of suction, the primary stream of air then carrying the required secondary air to guide the material to be suctioned in the air intake opening of the transport conduit along with it.

The second air conduit, for its part, exhibits its own air exit opening, likewise adjacent to the air intake opening of the transport conduit and preferentially located opposite to the injector nozzle, from which an air jet having high dynamical pressure and air velocity exits against the direction of suction and with which, if appropriate, it is possible to loosen or blow-free material to be blown or suctioned from the floor or ground, in cracks, or in inaccessible locations. Towards this end it can sometimes be advantageous if this air exit opening of the second air conduit has one or more auxiliary nozzles which are preferentially attachable to the air exit opening and which can, if appropriate, also exhibit different output opening angles.

A particular control configuration has this second air conduit being only partially opened by the control body with the first conduit being additionally fed with pressurized air via the control body, whereby it is possible, for example using an auxiliary nozzle, to direct the exiting air stream against the floor or ground in such a fashion that, by means of static partial pressure, the suction-material which has been lifted off the floor or ground, for example leaves, is suctioned-up directly by the injector nozzle through the air intake opening of the transport conduit and transported through the transport conduit into the filter receptacle.

The third air conduit terminates, for example, in such a fashion in the transport conduit between the air intake opening of the transport conduit and the air exit opening that primary air enters into the transport conduit opposite to the direction of suction, whereby an injector blower is fashioned with which secondary air can be suctioned through the air exit opening of the transport conduit opposite to the direction of suction and blown in the form of a wide stream of air out of the air intake opening of the transport conduit. This particular configuration of the injector nozzle has the advantage that, when suctioning with the injector, jammed suction-materials, for example twigs which have become lodged in the transport conduit, can be blown-free again by direct switching into the injector blowing direction.

Further details of the present invention can be derived from the following description of an exemplary embodiment.

DESCRIPTION OF THE PREFERRED EMBODIMENT

Figure 1:
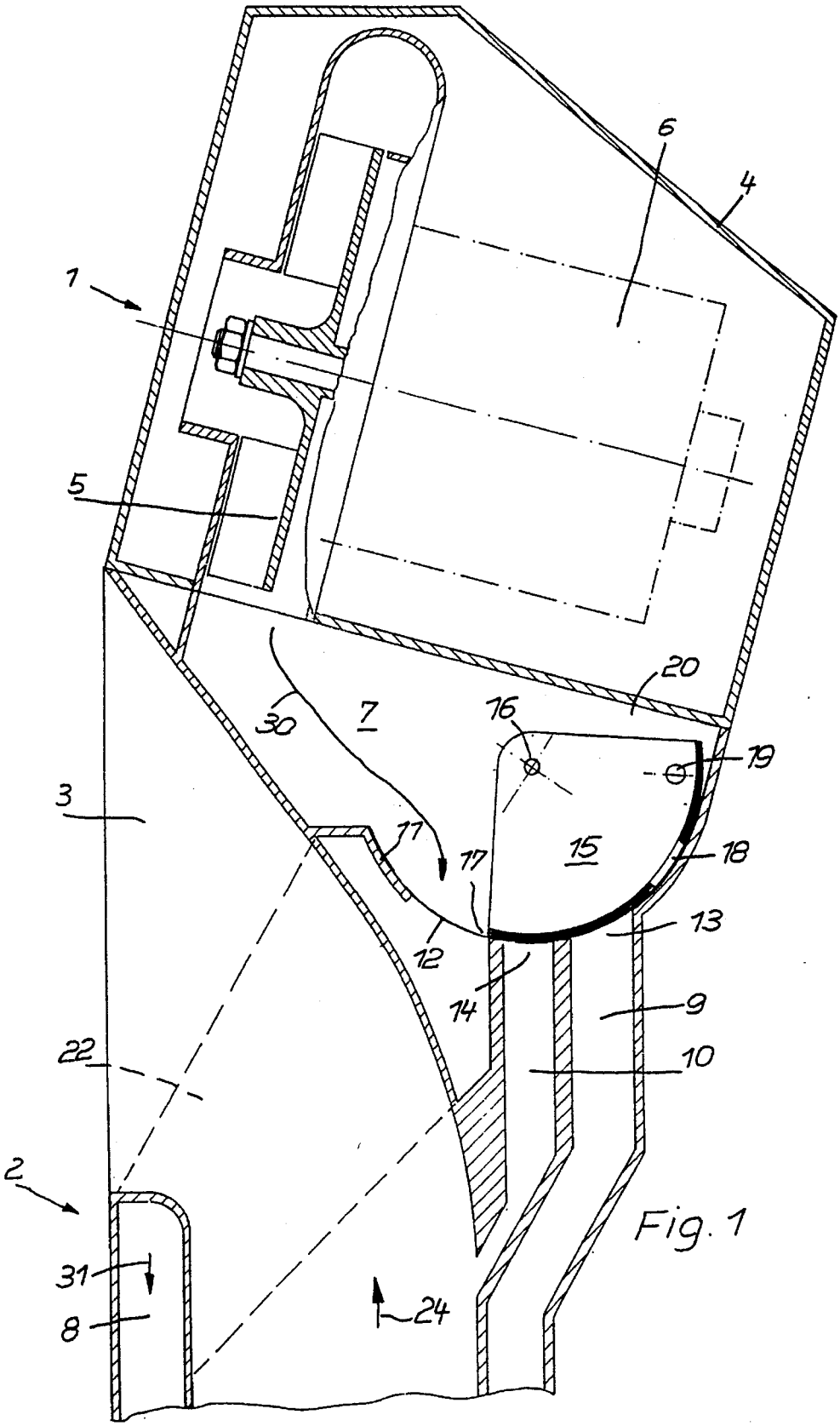
FIG. 1 shows a longitudinal section of the upper portion of the transport conduit.
Figure 2:
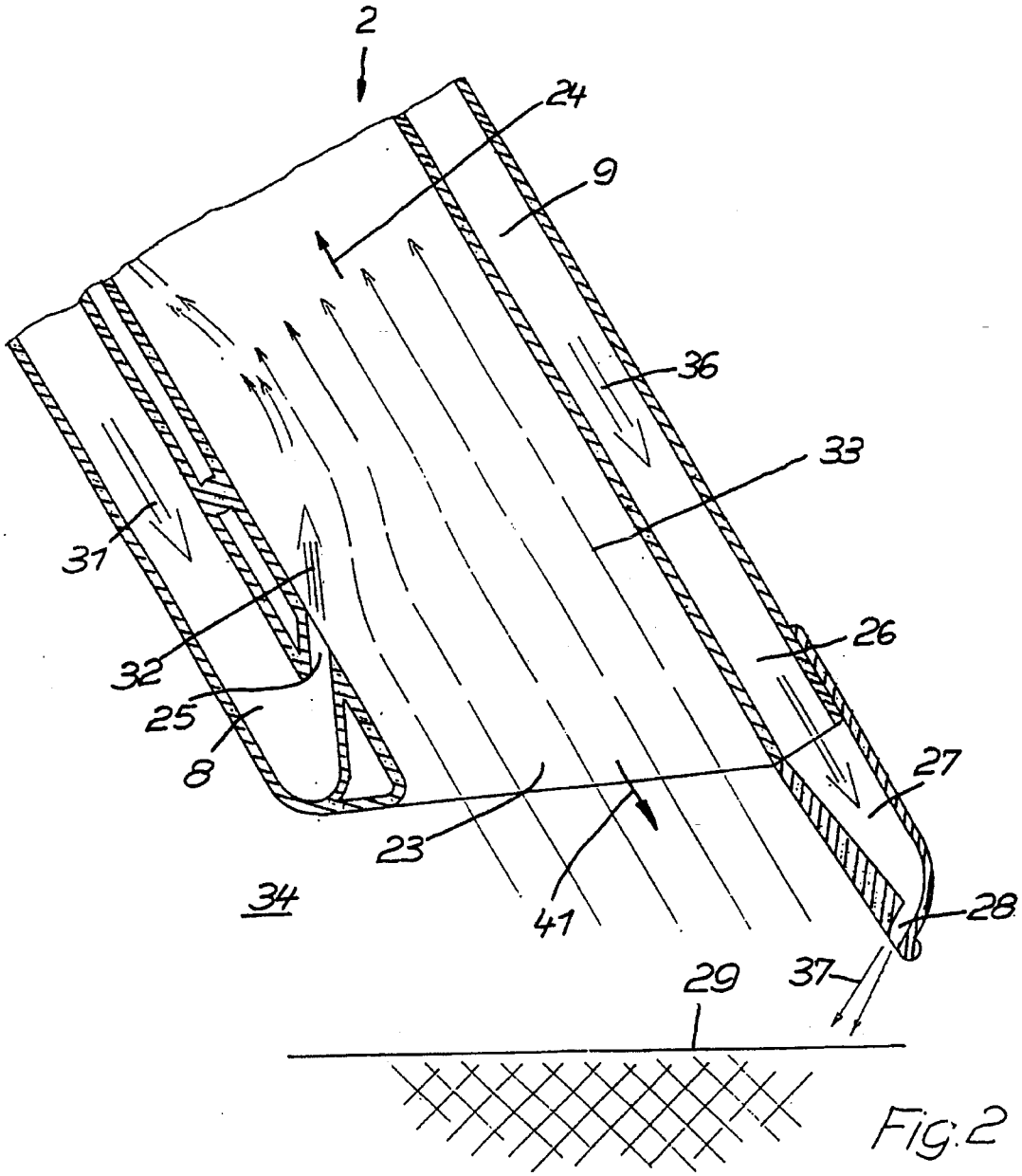
FIG. 2 shows a similar longitudinal cut through the corresponding lower portion of the transport conduit, FIG. 3 the section of FIG. 1 but with the rotary valve adjusted to feed the first and the second air conduits, FIG. 4 the section of FIG. 1 but with the rotary valve adjusted to feed the second air conduit only, FIG. 5 the section of FIG. 1 but with the rotary valve adjusted to feed the third air conduit.

FIG. 1 shows a longitudinal cut through the upper portion 1 of a partially illustrated transport conduit 2 to whose exit opening 3 a dust-bag (not explicitly shown) can be attached. A housing 4 is located adjacent to this exit opening in which a blower 5 serving as a source of pressurized air and an associated electric motor 6 are accommodated. A distribution area 7 is located between this housing 4 and the upper part of the conduit 1 in which three air conduits, labelled 8 through 10, are connected. A rotary valve, designated as 15 is provided to completely or partially close the air entrance passages 12 through 14 of the air conduits 8 through 10 located in the rounded wall 11 of the distribution area 7, the rotary valve 15 being mounted to pivot about a pin 16 and exhibits an outer control edge 17 as well as an air passage 18. In addition, this rotary valve 15 is also provided with a catch 19 which, in its blocking position, engages in four different recesses 21 located in the wall 20 of the distribution area 7.

As can be further seen from FIGS. 1 through 5 the first air conduit 8 connects the first air entrance passage 12 to the injector nozzle 25 which is directed approximately in the suction-direction 24 and located in the vicinity of the air intake opening 23 of the transport conduit 2. In contrast, the second air conduit 9 is arranged on the side of the transport conduit 2 lying opposite to the first air conduit 8 and connects, by means of its air entrance passage 13, the distribution area 7 to an air exit opening 26 positioned opposite to the injector nozzle 25. In accordance with the present embodiment an auxiliary nozzle, designated 27, is attached to this air exit opening 26 and has a slot-like exit passage 28 directed against the floor or ground 29 at an angle. In contrast the third air conduit 10, located between the two air conduits 8 and 9, is relatively short and already terminates in the upper portion of the transport conduit 2.

These air conduits 8 through 10 as well as the associated rotary valve 15 function as follows:

In accordance with FIG. 1, the rotary valve 15 assumes a first position in which its control edge 17 opens up the air entrance passage 12 to air conduit 8. In this manner the air introduced by the blower 5 in the direction of arrow 30 to the distribution area 7 can exit therefrom, via the air entrance passage 12 and the first air conduit 8 to stream in the direction of arrow 31 to injector nozzle 25 wherefrom this primary air pumped by the blower 5 enters in such a fashion into the lower portion 33 of the transport conduit 2 in the direction of arrow 32 that this primary air then carries secondary air along with it which, coming from the surrounding air 34 in the lower portion 33 of the transport conduit 2 enters into the transport conduit 2 through the air intake opening 23 and in this fashion conduits suction-materials located on the floor or ground 29 in the direction of the arrow 24 to a filter-sack (not explicitly shown) attached to the upper portion 1. The lower lying injector nozzle 25 has the particular advantage that heavy suction-materials which, due to the force of gravity, drop onto the lower portion 33, enter to the primary air stream and are transported additionally along therewith, since after exiting out of the injector nozzle 25, primary air is present in the lower portion 33.

Figure 3:
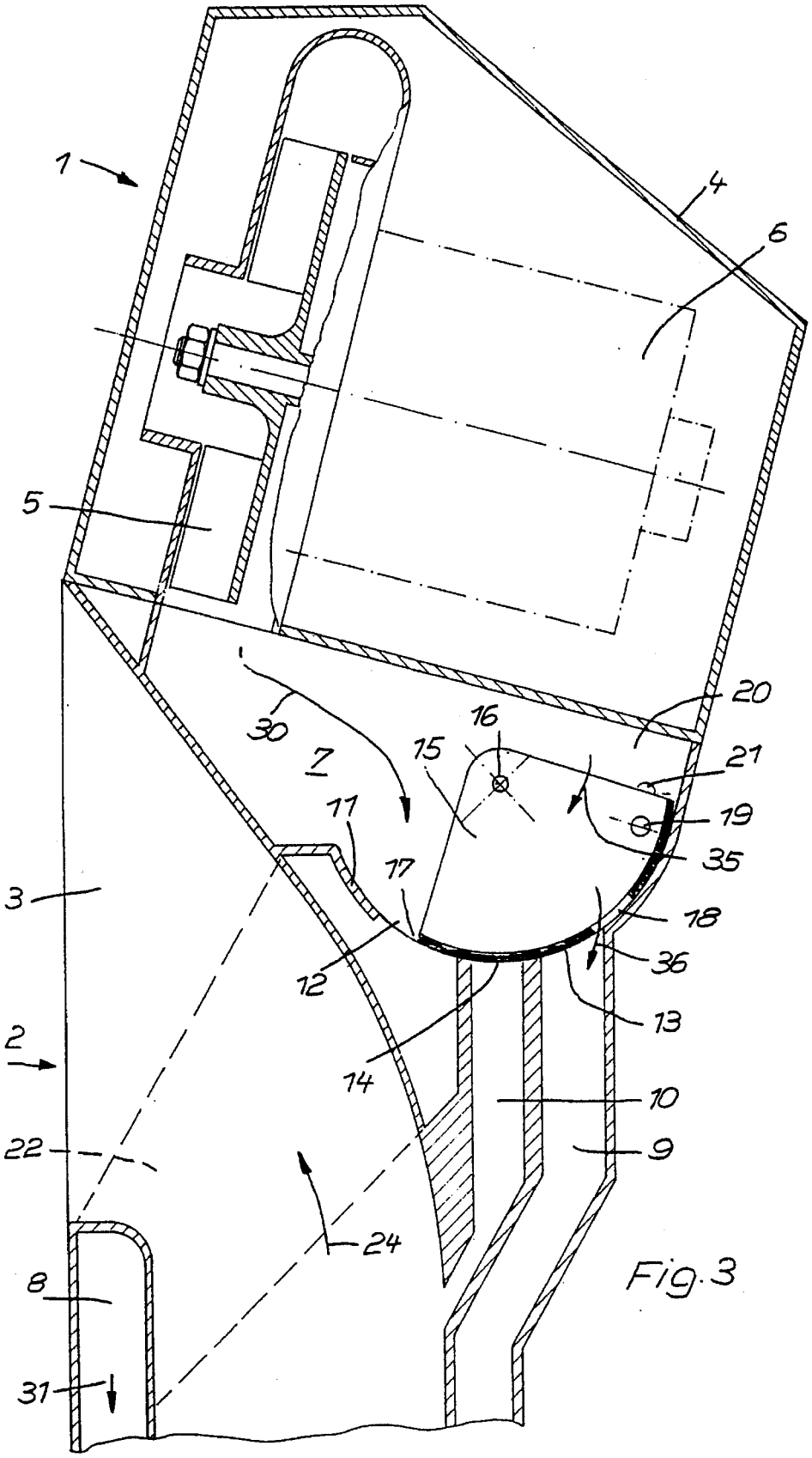

If the rotary valve 15 is subsequently rotated in the direction of arrow 35 to the intermediate position shown in FIG. 3, then the air entrance passage 12 to the first air conduit 8 is only partially opened, whereby a partial amount of air can also flow into the second air conduit 9 in the direction of arrow 36 by means of air passage 18 located in rotary valve 15. This partial quantity of air travels through the second air conduit 9 to its air exit opening 26 and to the auxiliary nozzle 27 attached thereto and finally exits out of exit passage 28. This stream of air directed in the direction of arrow 37 stirs up suction-material from the floor or ground 29 which then can be taken up by the secondary air pulled along by the primary air to be introduced in the direction of arrow 24 to the filter receptacle.

Figure 4:
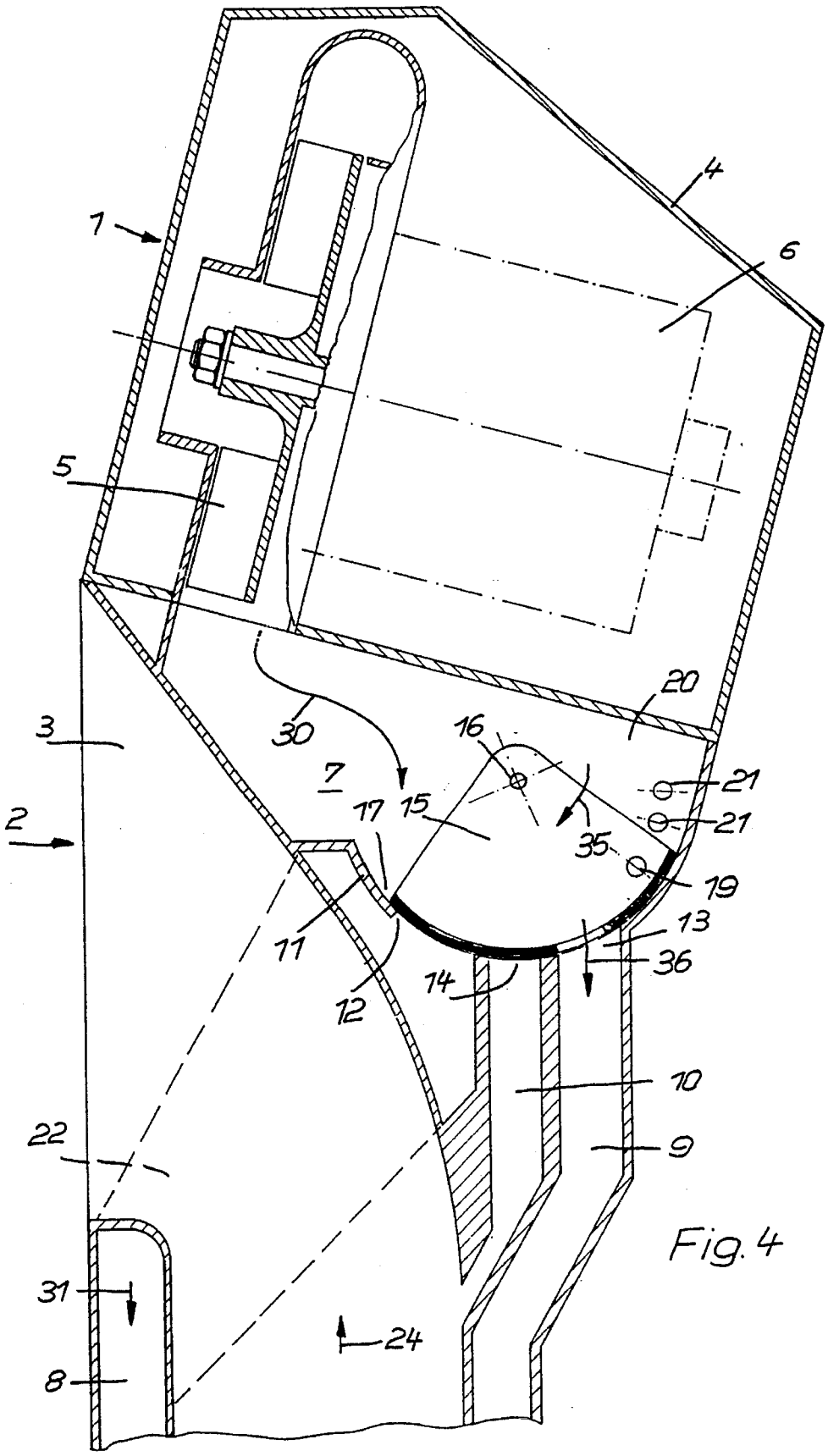

In the additional FIG. 4, the rotary valve 15 assumes a control position in which it completely closes the air entrance passage 12 of the first conduit 8, whereby air passage 18 of rotary valve 15 passes the complete stream of air to the second air conduit 9 in the direction of arrow 36. In this fashion the entire amount of air pumped by the blower 5 travels through the second air conduit 9 to its exit opening 26 and auxiliary nozzle 27. This stream of air exiting out of auxiliary nozzle 27 in the direction of arrow 37 causes, on the one hand, an intense stirring-up of objects located on the floor or ground 29, and on the other hand, simultaneously also causes a slight lifting-up of the suction device at lower portion 33 of the transport conduit as is particularly clear in FIG. 2.

Figure 5:
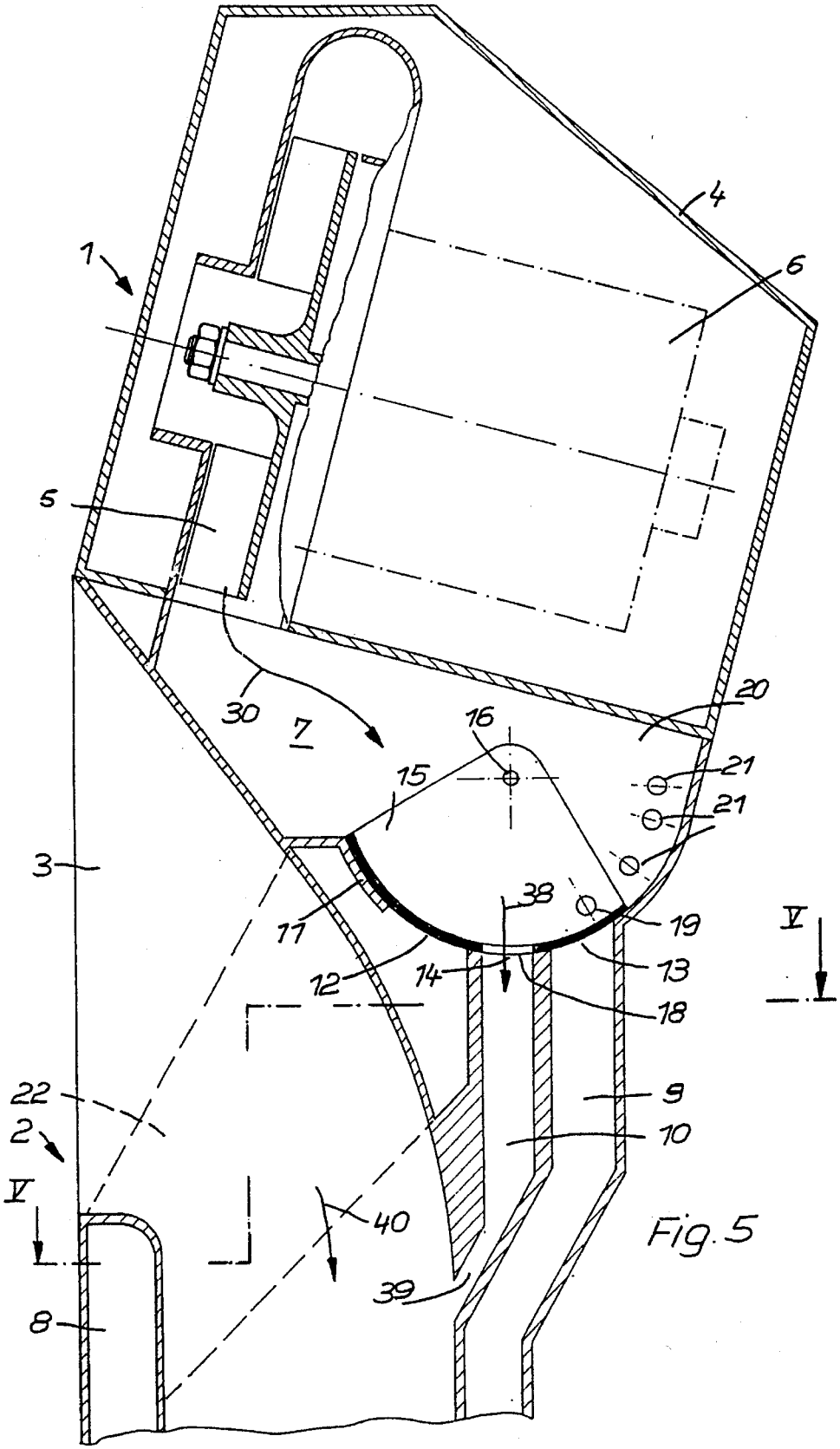

Subsequent FIG. 5 finally shows the other end position of the rotary valve 15 in which the air entrance passages 12 and 13 of both air conduits 8/22 and 9 are closed and, in contrast, the air entrance passage 14 to the third air conduit 10 is opened. Air pumped from the blower 5 can thereby gain entrance in the direction of arrow 38 to the middle air conduit 10 and travel through its exit opening 39 in the upper part 1 of the transport conduit 2, whereby this primary air then carries along secondary air with it from the exit opening 3 of the suction conduit 2 in the direction of arrow 40 so that a stronger stream of air 41 exits out of the air intake opening 23 of the transport conduit lower portion 33 directed opposite to arrow 24 against the floor or ground 29 to blow away objects located thereon. In this fashion, it is also possible to blow clear a transport conduit 2 which is clogged by suction-object blockage.

The rotary valve 15 preferentially comprises thin elastic material. In this manner it is possible to press it, by means of air pressure, with sufficient strength against the rounded wall 11 of the distribution area 7 to obviate the need for special sealing of these portions with respect to each other.

Figure 6:
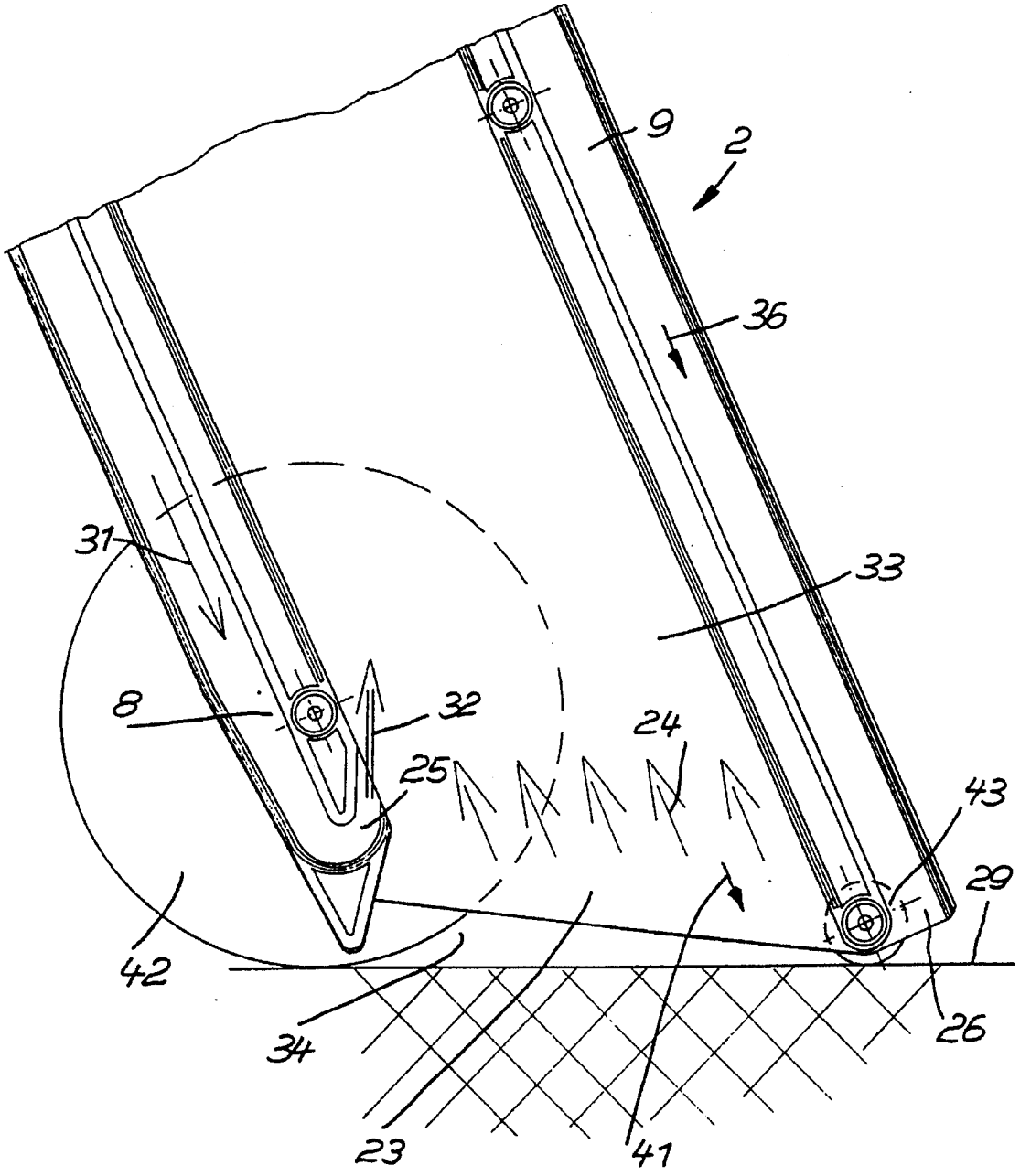
FIG. 6 shows a different configuration of the suction opening of the transport conduit.
Figure 7:
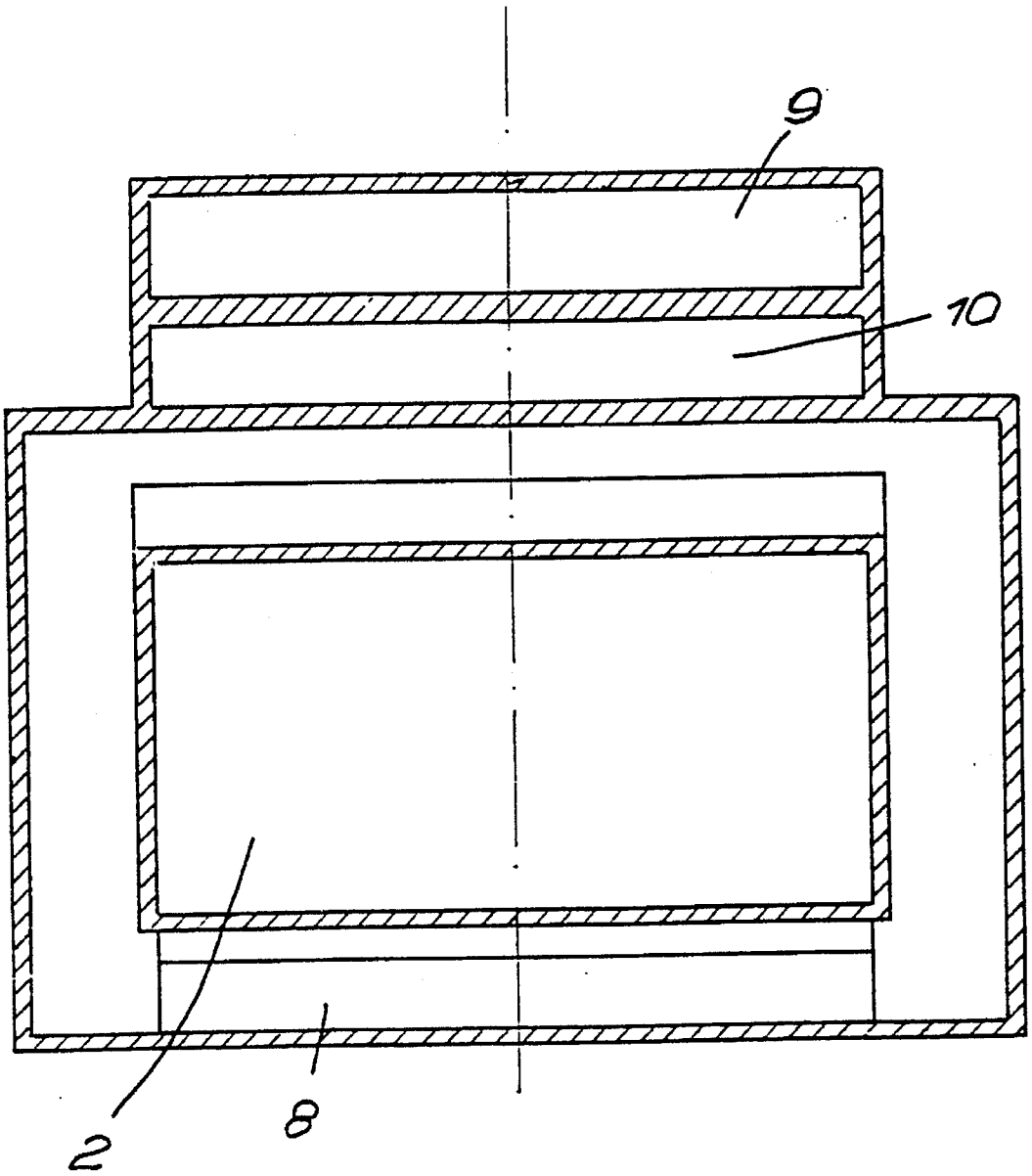
FIG. 7 is a cut V—V of FIG. 5

Since the suction device in accordance with the invention is not only appropriate for vacuum cleaning devices but also for larger devices, in particular for use outdoors, it is also advantageous if the lower portion 33 of the transport conduit 2 is equipped with appropriate rolling means 42 and 43 as shown in FIG. 6.

We claim:

1. A suction and blowing device comprising: an air pressure source means;

an air transport means, having an air intake opening and an air exit opening;

first, second, and third connecting conduit means each having an input and an output, each output communicating with the air transport means wherein one of said outputs communicates with said air transport means so as to produce a suction flow in said air transport means.

a control means connected between the air pressure source means and each input of the connecting conduit means for controlling air flow to the first, second and third connecting conduit means; and nozzle means connected to at least one output of the first and second connecting conduit means and communicating with the air transport means, wherein the output of the second connecting conduit means is adjacent to the air intake opening of the air transport means.

2. The suction and blowing device of claim 1, wherein the control means comprises a rotary valve for opening, closing, and partially closing the inputs of the connecting conduit means.

3. The suction and blowing device of claim 1, wherein the inputs of the connecting conduit means are directly adjacent to each other.

4. The suction and blowing device of claim 1, wherein the nozzle means communicate with the first connecting conduit means and with the air intake opening of the air transport means.

5. The suction and blowing device of claim 4, wherein the output of the second connecting conduit means is located opposite to the nozzle means communicating with the first connecting conduit means.

6. The suction and blowing device of claim 4, further comprising auxiliary nozzle means communicating with the output of the second connecting conduit means.

7. The suction and blowing device of claim 6, wherein the auxiliary nozzle means comprises an angled end having an air exit passage.

8. The suction device of claim 1, wherein the third connecting conduit means connects to the air transport means at a location between the air intake opening and the air exit opening.

9. The suction and blowing device of claim 8, wherein the third connecting conduit means connects to the air transport means at a location adjacent to the air exit opening.

* * * * *